US010041256B2

(12) United States Patent
Scully et al.

(10) Patent No.: US 10,041,256 B2
(45) Date of Patent: Aug. 7, 2018

(54) UNDERCUT CLIP ANCHOR SYSTEM FOR CLADDING OF MATERIALS

(71) Applicant: Eclad USA, Inc., Chicago, IL (US)

(72) Inventors: Joe Scully, Dublin (IE); Tom Scully, Dublin (IE); Sean Daly, Dublin (IE)

( * ) Notice: Subject to any disclaimer, the term of this patent is extended or adjusted under 35 U.S.C. 154(b) by 0 days.

(21) Appl. No.: 14/884,734

(22) Filed: Oct. 15, 2015

(65) Prior Publication Data

US 2016/0145875 A1 May 26, 2016

Related U.S. Application Data

(60) Provisional application No. 62/064,019, filed on Oct. 15, 2014.

(51) Int. Cl.

| | |
|---|---|
| ***E04B 1/38*** | (2006.01) |
| ***E04C 5/00*** | (2006.01) |
| ***E04F 13/08*** | (2006.01) |
| ***E04F 13/14*** | (2006.01) |
| ***E04B 1/41*** | (2006.01) |

(52) U.S. Cl.

CPC ..... *E04F 13/081* (2013.01); *E04B 1/40* (2013.01); *E04F 13/083* (2013.01); *E04F 13/0807* (2013.01); *E04F 13/0816* (2013.01); *E04F 13/14* (2013.01)

(58) Field of Classification Search

CPC ..... E04F 13/0807; E04F 13/0808; E04F 13/0816; E04F 13/081; E04F 13/083; E04F 13/14; E04B 1/40

See application file for complete search history.

(56) References Cited

U.S. PATENT DOCUMENTS 3,561,182 A * 2/1971 Madl, Jr. ..... E04B 2/96 52/235
4,070,835 A * 1/1978 Reverend ..... E04F 13/0816 52/126.1
4,307,551 A * 12/1981 Crandell ..... E04F 13/0808 52/204.591
4,768,321 A * 9/1988 Crandell ..... E04F 13/0808 52/235
5,065,557 A * 11/1991 Laplante ..... E06B 3/5427 52/235
5,720,571 A * 2/1998 Frobosilo ..... E04B 2/96 403/2

(Continued)

FOREIGN PATENT DOCUMENTS

| | | |
|---|---|---|
| DE | 7509864 U | 7/1975 |
| EP | 0264707 A2 | 4/1988 |
| EP | 0882853 A1 | 12/1998 |

OTHER PUBLICATIONS

European Search Report in corresponding EP application, dated Apr. 24, 2018 (8 pages).

*Primary Examiner* — Brian D Mattei
(74) *Attorney, Agent, or Firm* — Charles T. Riggs, Jr.

(57) ABSTRACT

The present subject matter relates to method(s), system(s) and device(s) for cladding of materials, and in particular to an undercut clip anchor system. The system comprises a horizontal rail which mounts both an upper undercut clip and a lower undercut clip for attaching an upper cladding panel and a lower cladding panel, respectively. Serrations on the undercut clips and on a nut bar serrated washer allow for the accurate vertical adjustment of the cladding panels.

20 Claims, 23 Drawing Sheets

(56) References Cited

U.S. PATENT DOCUMENTS

| | | | | |
|---|---|---|---|---|
| 6,170,214 | B1 * | 1/2001 | Treister | E04F 13/0808 52/235 |
| 6,425,218 | B1 * | 7/2002 | Doyon | E04F 13/081 403/295 |
| 8,782,969 | B2 * | 7/2014 | Eickhof | E04H 13/006 52/134 |
| 2003/0150179 | A1 * | 8/2003 | Moreno | E04F 13/0808 52/235 |
| 2006/0185274 | A1 * | 8/2006 | Merica | E04B 2/90 52/235 |
| 2010/0325997 | A1 * | 12/2010 | Scully | E04F 13/0805 52/489.1 |
| 2011/0113706 | A1 * | 5/2011 | Krause | F41H 5/263 52/204.5 |
| 2013/0111840 | A1 * | 5/2013 | Bordener | E04B 1/68 52/393 |
| 2013/0118107 | A1 * | 5/2013 | Maday | E04B 2/00 52/506.05 |
| 2013/0205698 | A1 * | 8/2013 | Todd | E04F 13/0805 52/302.1 |
| 2014/0161516 | A1 * | 6/2014 | Deumer | E04F 13/081 403/345 |
| 2015/0308123 | A1 * | 10/2015 | Prica | E04F 13/0801 52/483.1 |

* cited by examiner

UNDERCUT CLIP ANCHOR SYSTEM FOR CLADDING OF MATERIALS

RELATED APPLICATION

This Application relates to and claims priority to U.S. Provisional Patent Application No. 62/064,019 filed Oct. 15, 2014, herein incorporated by reference.

TECHNICAL FIELD

The exemplary teachings herein pertain to method(s), system(s) and device(s) used in the field of anchorage systems for facades or cladding of materials, for example as may be disclosed in U.S. Pat. No. 8,365,481, the entire disclosure of which is herein incorporated by reference.

BACKGROUND

Other products used to anchor cladding materials via undercut anchors require two horizontal rails per row of material or do not incorporate a bolt/nut vertical adjustment.

If the material is not thick enough to allow for kerf or pin anchors that support the stone from the top, bottom or sides, there are other products to accommodate this such as:

Concealed Anchoring System for Façade Panels by Keil. However, this system requires two horizontal rails behind each panel of stone. The drawback of this system is that it requires two horizontal rails behind each panel of stone. Because there are two horizontal rails, there is twice as much material than a single rail. Therefore, the cost of material will be higher and more labor will be required to install two rails. Also, the adjusting bolts are located further from the top of the cladding panel, which makes it more difficult to adjust.

Sureclad by Crossville. However, this system does not incorporate a bolt/nut vertical adjustment. This system also requires fasteners to connect to the horizontal rails. The drawback of this system is that it does not incorporate adjusting bolts, so the vertical alignment of the cladding panel is not simple or easy to adjust. Also, screws or fasteners are required to connect the "straps" attached to the panel to the horizontal "rail".

Therefore, a need exists for one or more methods, systems and devices which are directed towards overcoming the above described problems, limitation or deficiencies. Accordingly, address the above stated issues, the method(s), system(s) and device(s) disclosed herein fulfill such a need by providing an improved undercut clip anchor system for cladding of materials.

SUMMARY

The exemplary technique(s), system(s), device(s) and method(s) presented herein to an undercut clip anchor system for cladding of materials. The disclosed undercut clip anchor system comprises only one horizontal rail ("H3") per row stone, whereas other known undercut anchoring systems incorporate two horizontal rails per row of stone. Serrations on the undercut clip ("UCC") and nut bar serrated washer ("NB3") allow for adjustments needed to accommodate for stone tolerances; or if the undercut clips were not installed correctly (due to human error), they can easily be adjusted. The undercut clips cannot be seen through the joints in the cladding material. The unique bolt/nut/track design disclosed herein allows for highly accurate adjustment of stones vertically.

Accordingly, the undercut clip anchor system of the present disclosure provides for accurate installation of panel cladding materials (natural stone, porcelain, concrete, etc.). Further, the undercut clips are not seen through the horizontal joint between panels. Additionally, only one horizontal rail is needed and used per row of stone. Also, a single rail supports the weight the stone below it and restrains the stone above it from rotation. The system allows for cladding of thinner materials (less than 3 cm) that cannot be anchored at the top, bottom, or sides. A unique bolt/nut/track design allows for highly accurate adjustment of stones vertically. Serrations on the UCC and NB3 allow for adjustments needed to accommodate for stone tolerances or installation errors. The minimal amount of different pieces used in the systems minimizes confusion and makes installation relative quick and easy.

Additional objects, advantages and novel features will be set forth in part in the description which follows, and in part will become apparent to those skilled in the art upon examination of the following and the accompanying drawings or may be learned by production or operation of the examples.

BRIEF DESCRIPTION OF THE DRAWINGS

The drawing figure depict one or more implementations in accord with the present teachings, by way of example only, not by way of limitation. In the drawing figures, like reference numerals refer to the same or similar elements. As may be used herein, M3 refers to mullion, HLC refers to horizontal lock clip, MSC refers to mullion support, clip, UCC1 refers to undercut clip, NE2 refers to blockwork, H4 refers to horizontal rail, INS refers to insulation, NE1 refers to concrete slap, F01 refers to M12 expansion bolt, WT1 refers to wall tie anchor, SB1 refers to slide bar, F31 refers to self-drilling screw, NB1 refers to nut bar, F21 refers to DIN933 M12×25 bolt, UM1 refers to M1 mullion splice, and DPC refers to damp proof course.

DETAILED DESCRIPTION

Figure 1:
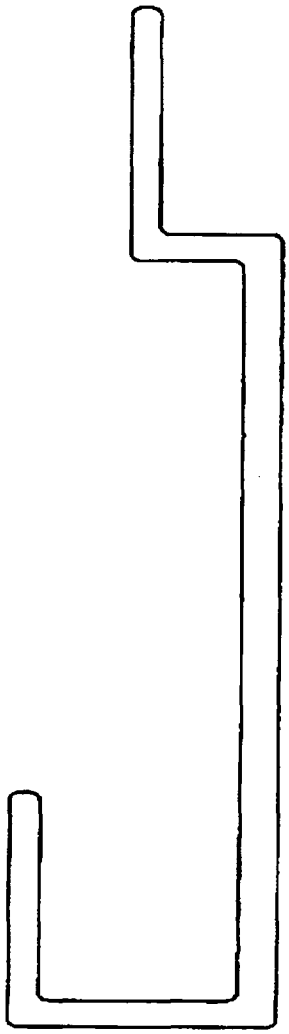
FIG. 1 is an enlarged side view of the H3 horizontal rail of the disclosed system.
Figure 2:
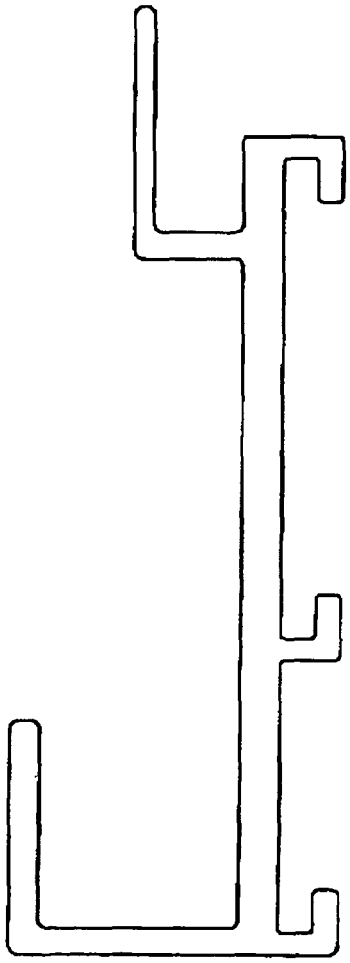
FIG. 2 is a side view of the alternate H3.1 horizontal rail.
Figure 3:
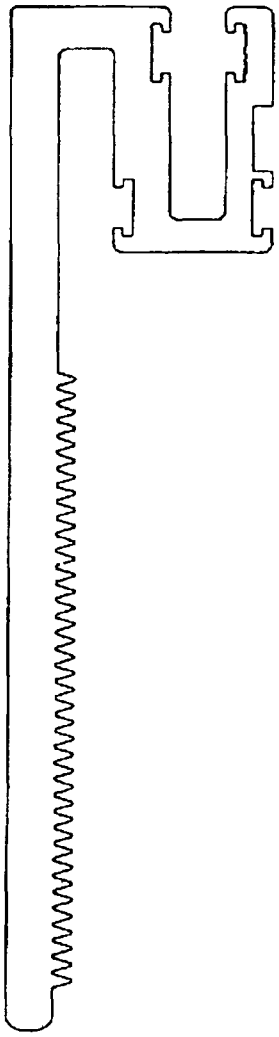
FIG. 3 is a side view of the UCC1 undercut clip of the disclosed system.
Figure 4A:
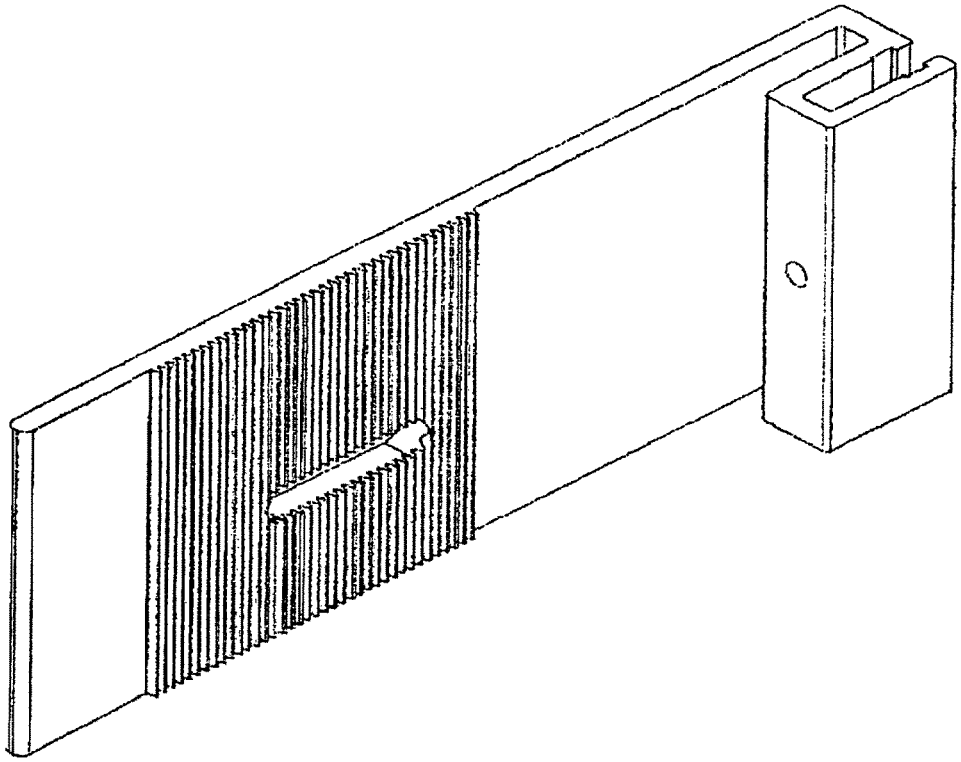
FIG. 4A is a perspective view of the UCC2 undercut clip of the disclosed system.
Figure 4B:
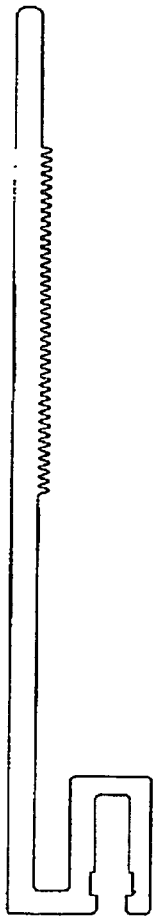
FIG. 4B is a side view of the UCC2 undercut clip.
Figure 5:
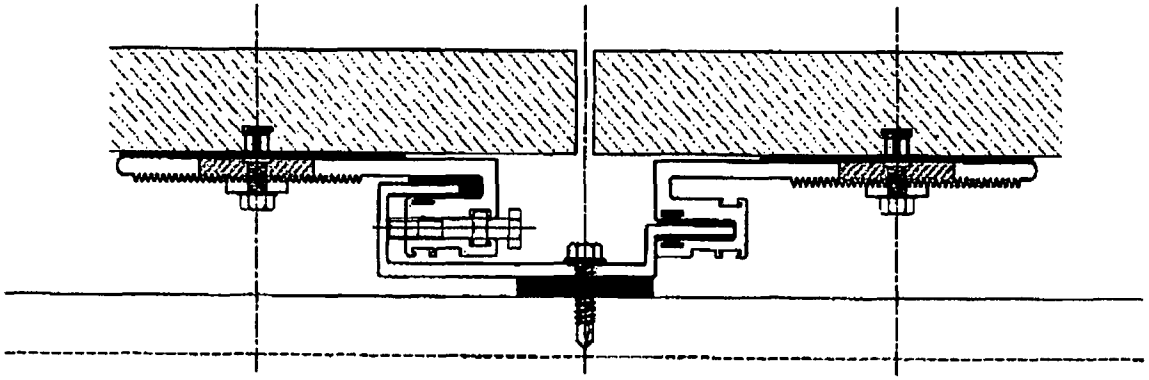
FIG. 5 is a side view of the undercut clip anchor system of the present disclosure in use.
Figure 6A:
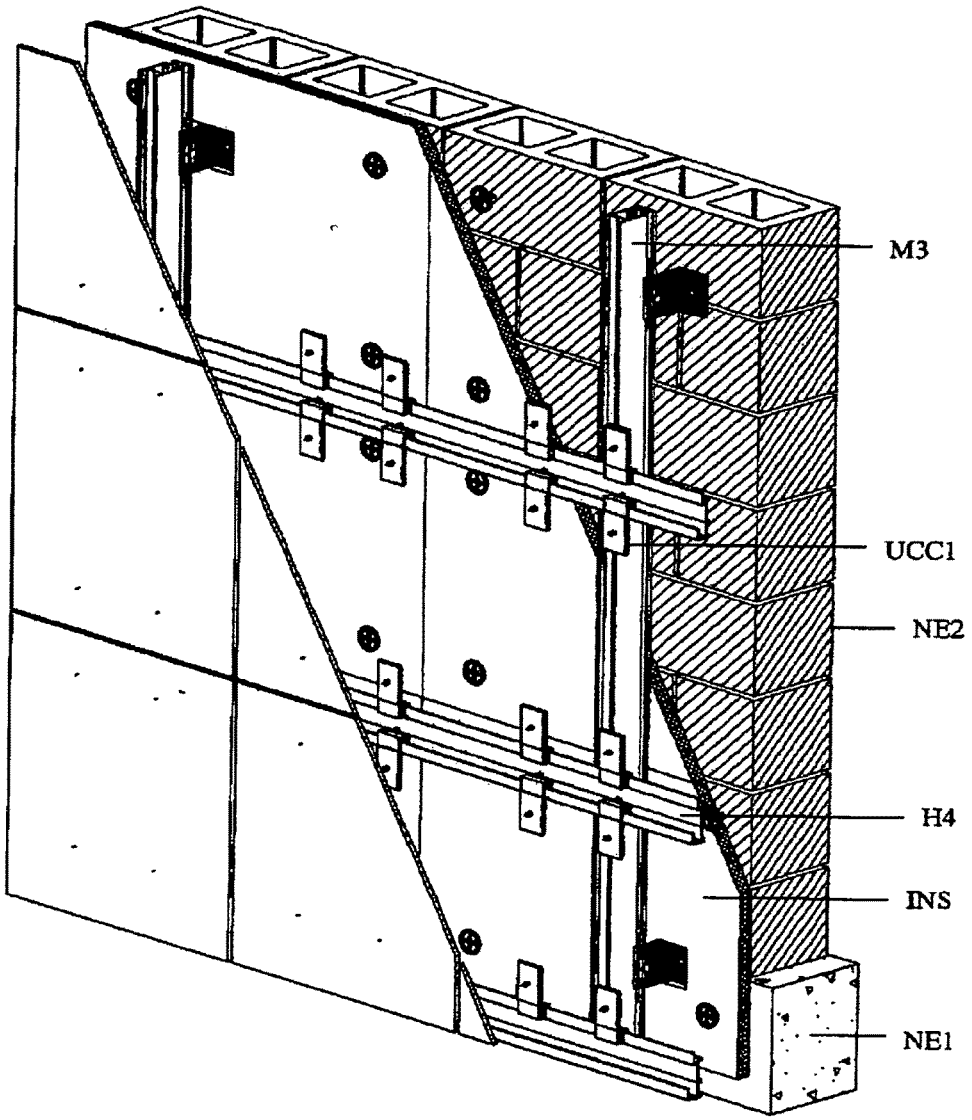
FIG. 6A is a partially cut away perspective view of the undercut clip anchor system of the present disclosure in use.
Figure 6B:
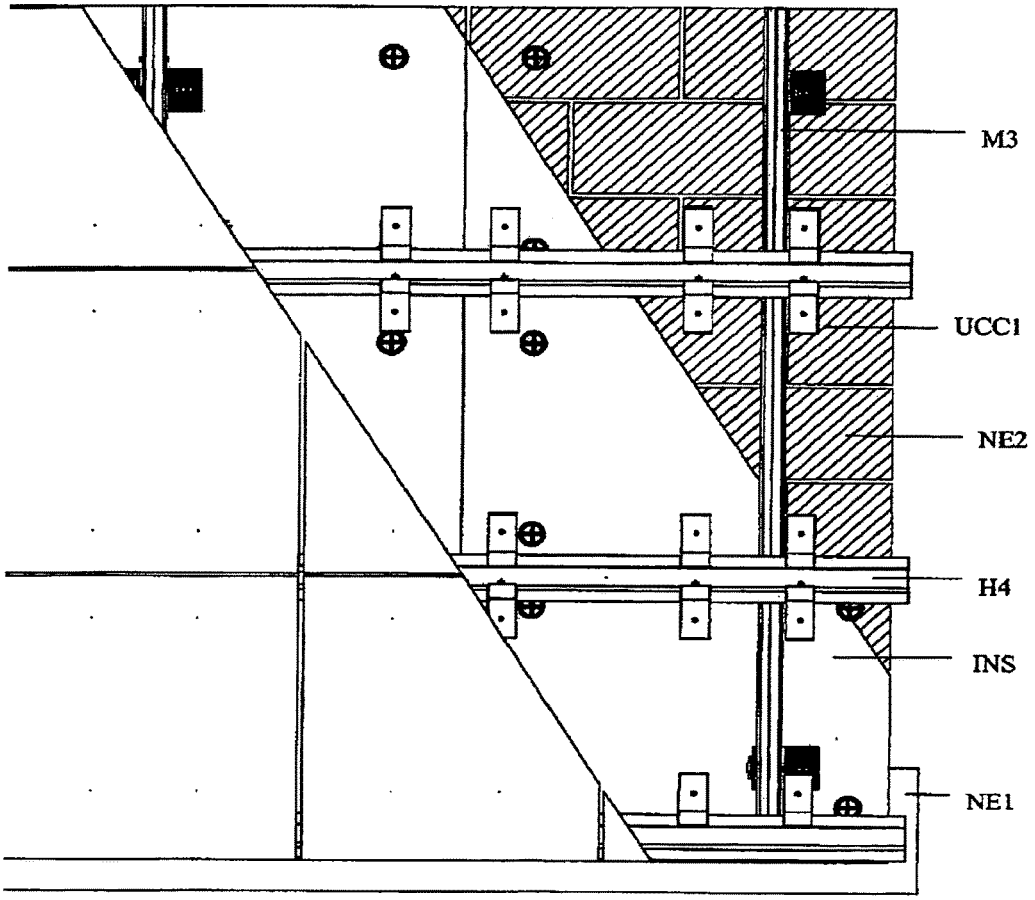
FIG. 6B is a front view of the undercut clip anchor system of FIG. 6A.
Figure 6C:
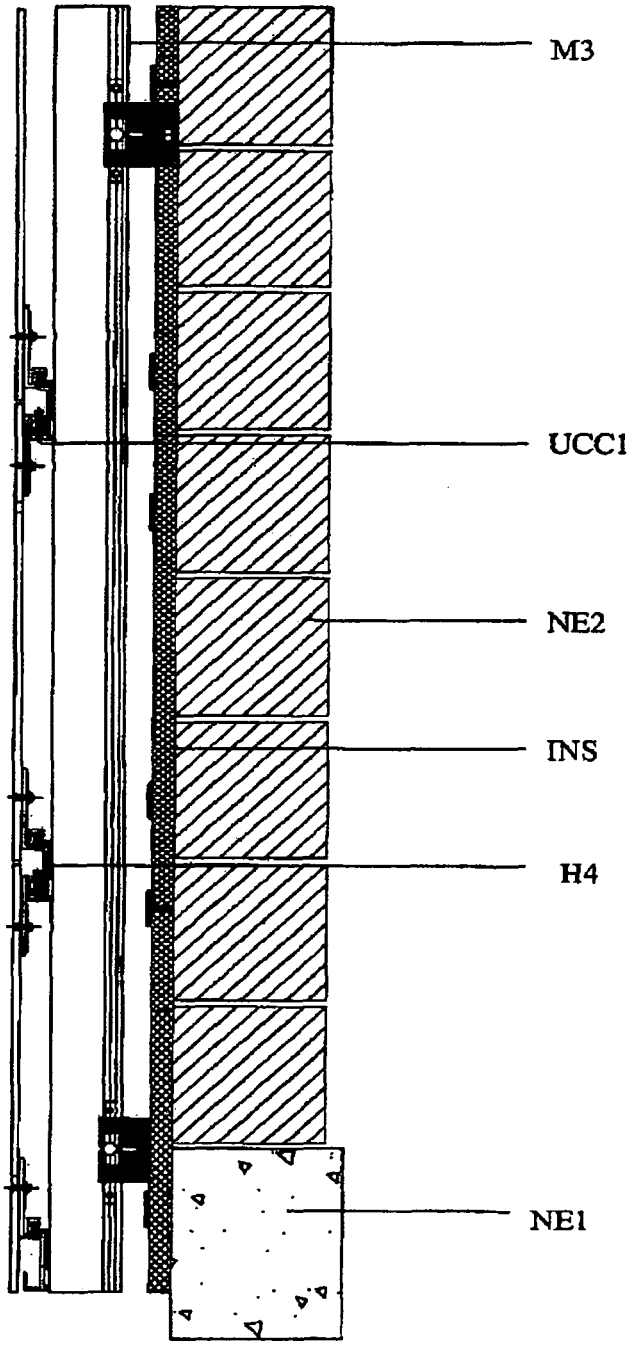
FIG. 6C is a side view of the undercut clip anchor system of FIG. 6A.
Figure 6D:
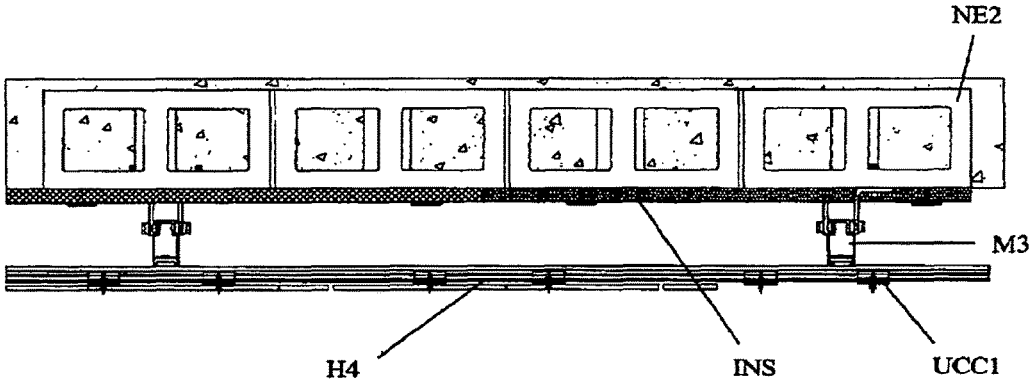
FIG. 6D is a top view of the undercut clip anchor system of FIG. 6A.
Figure 7A:
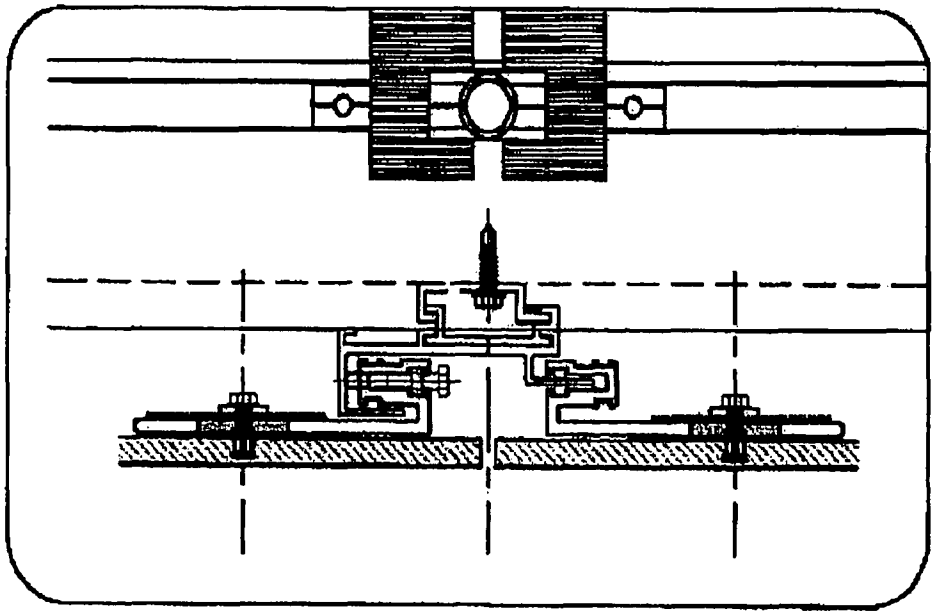
FIGS. 7A-7F are views illustrating typical system dimensions of the undercut clip anchor system of the present disclosure in use.
Figure 7B:
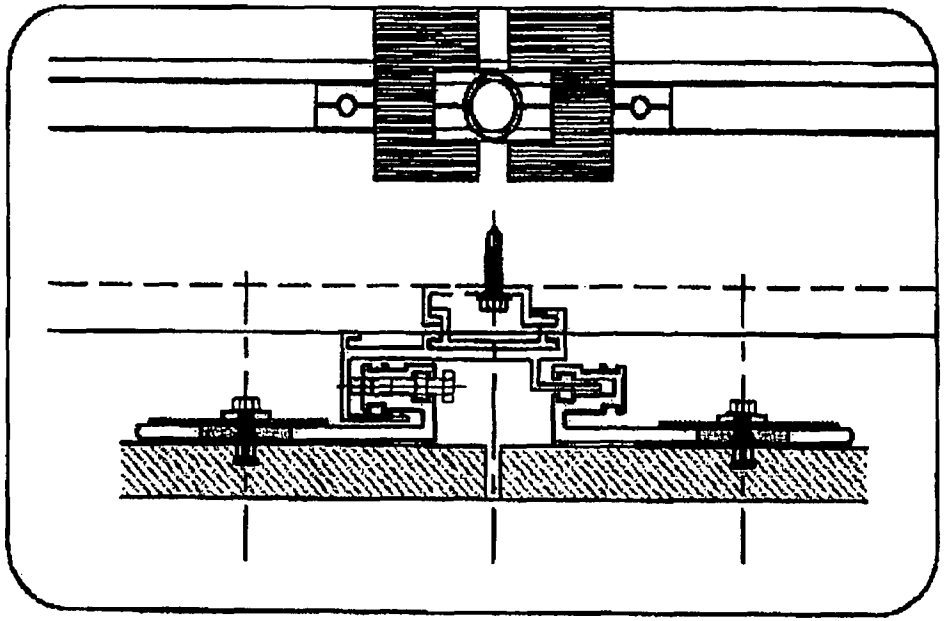
Figure 7C:
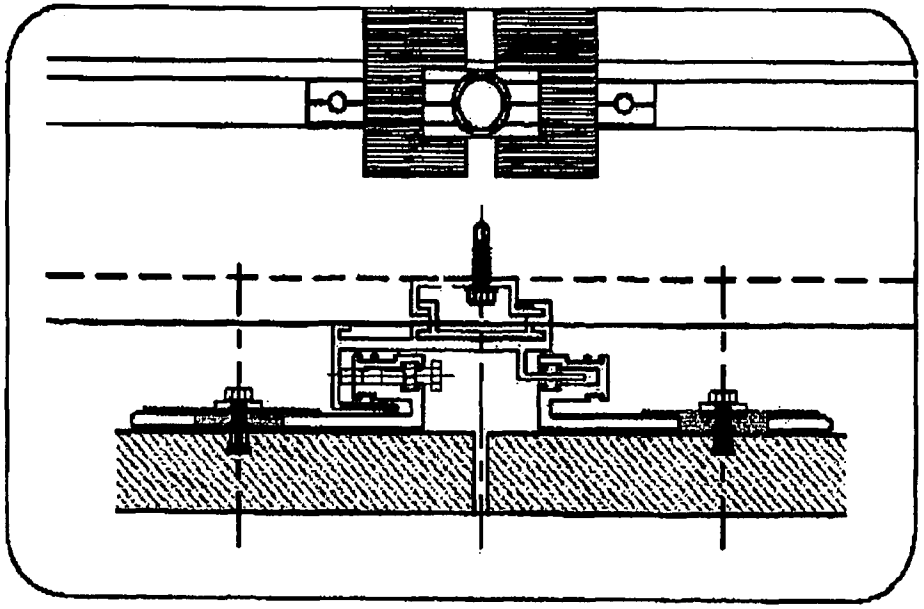
Figure 7D:
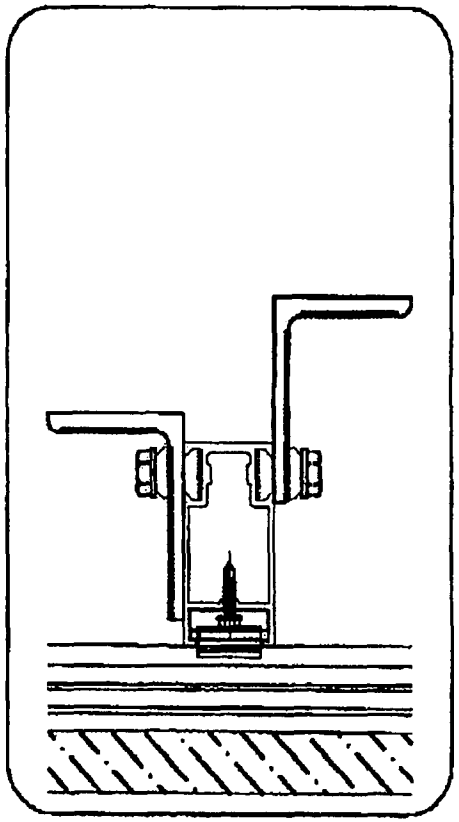
Figure 7E:
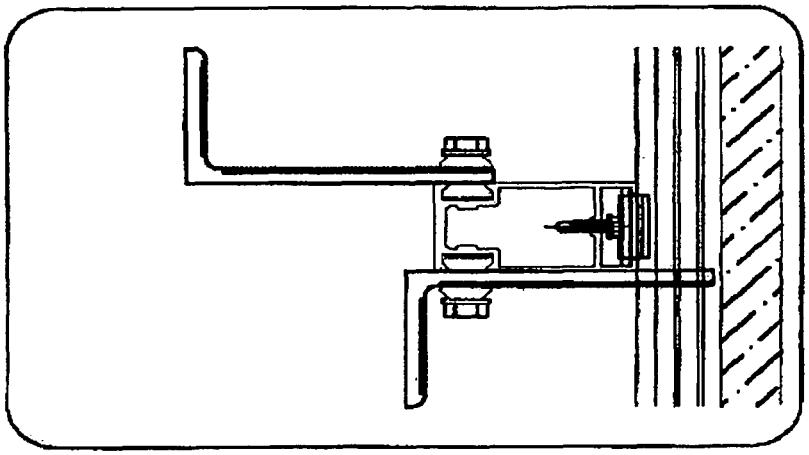
Figure 7F:
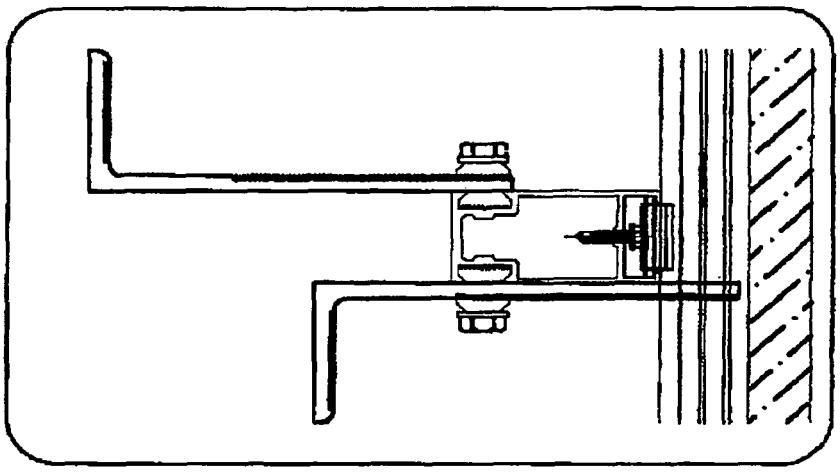
Figure 8:
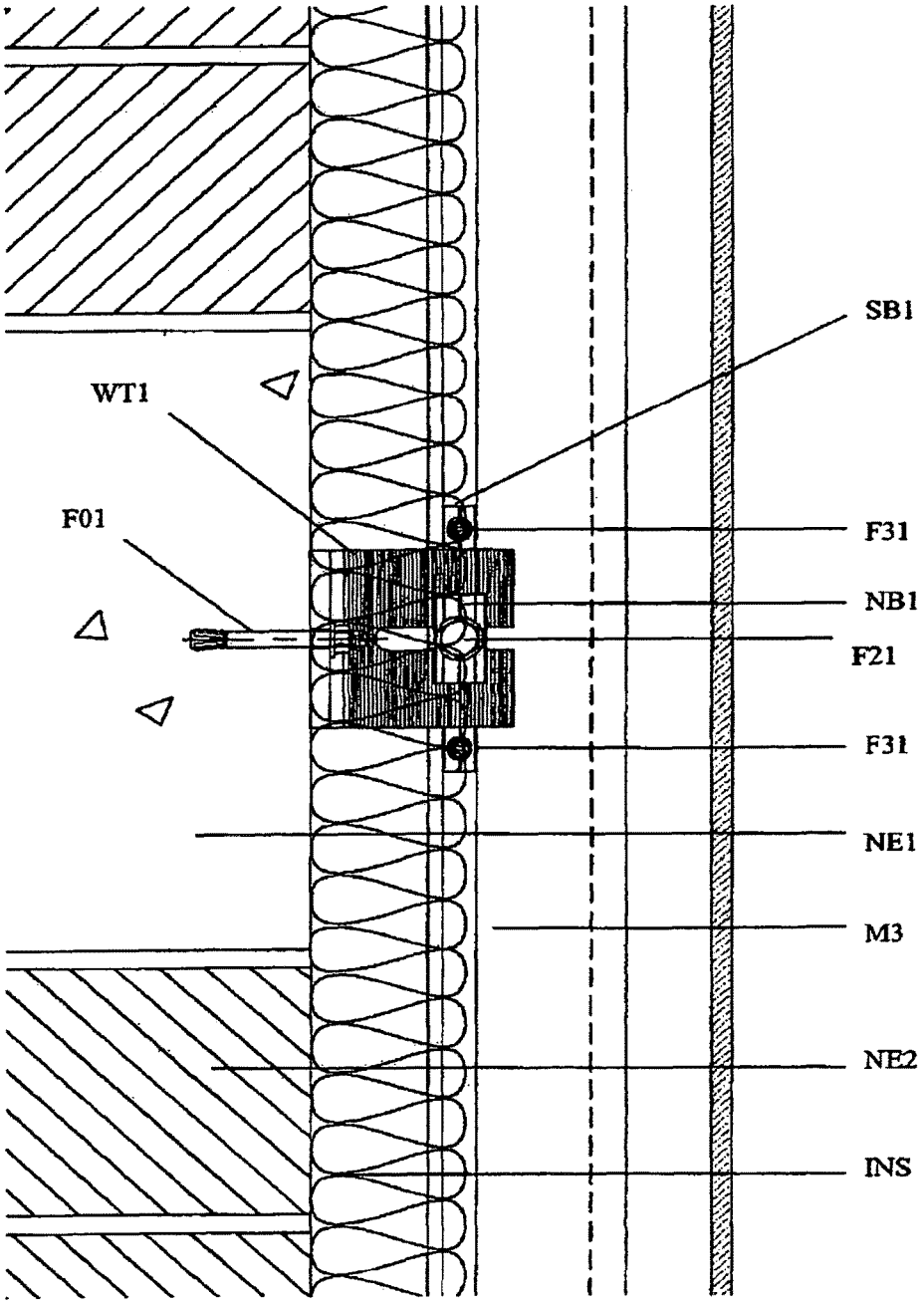
FIG. 8 is a view illustrating typical dead load anchor detail of the undercut clip anchor system of the present disclosure in use.
Figure 9:
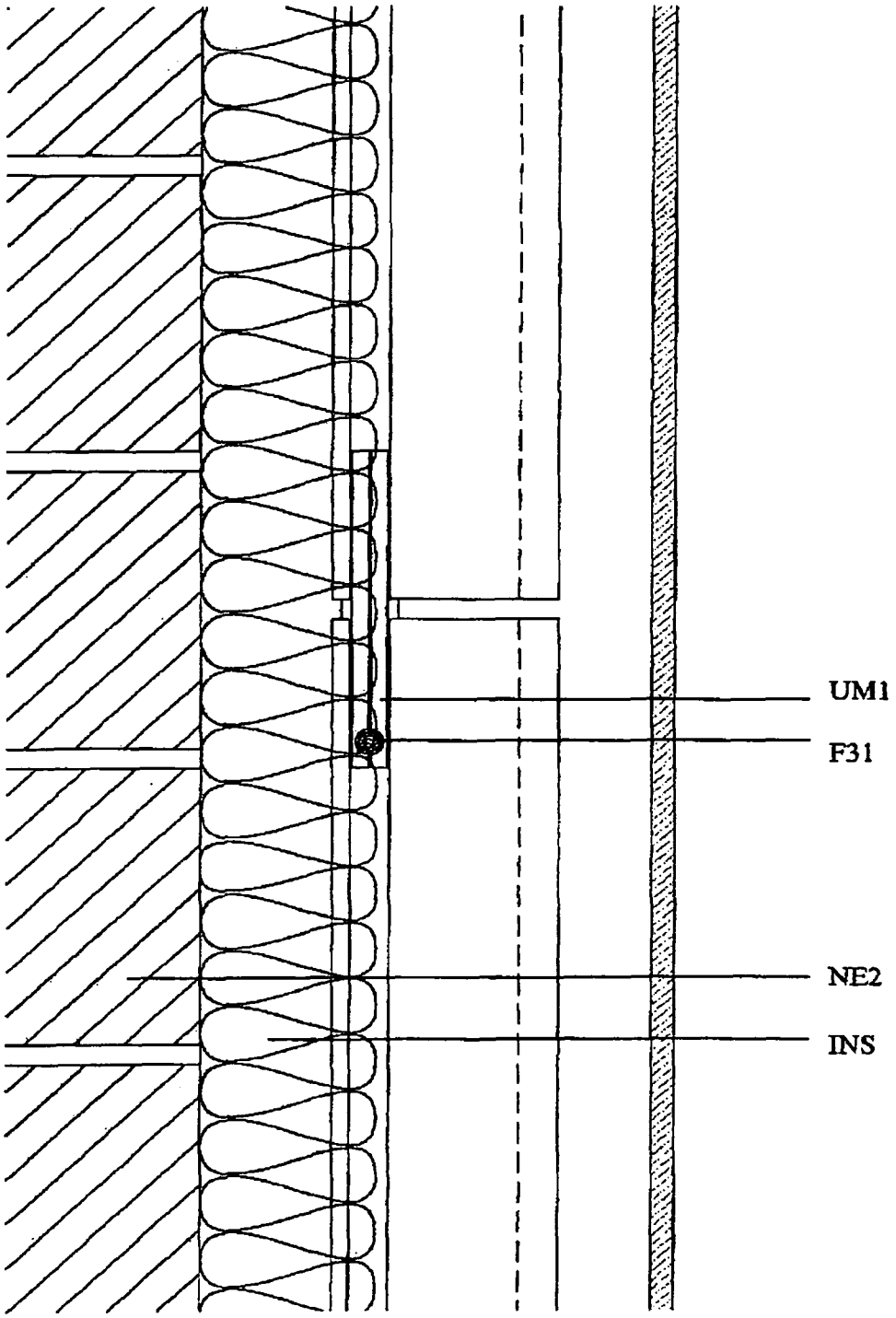
FIG. 9 is a view illustrating typical mullion splice detail of the undercut clip anchor system of the present disclosure in use.
Figure 10:
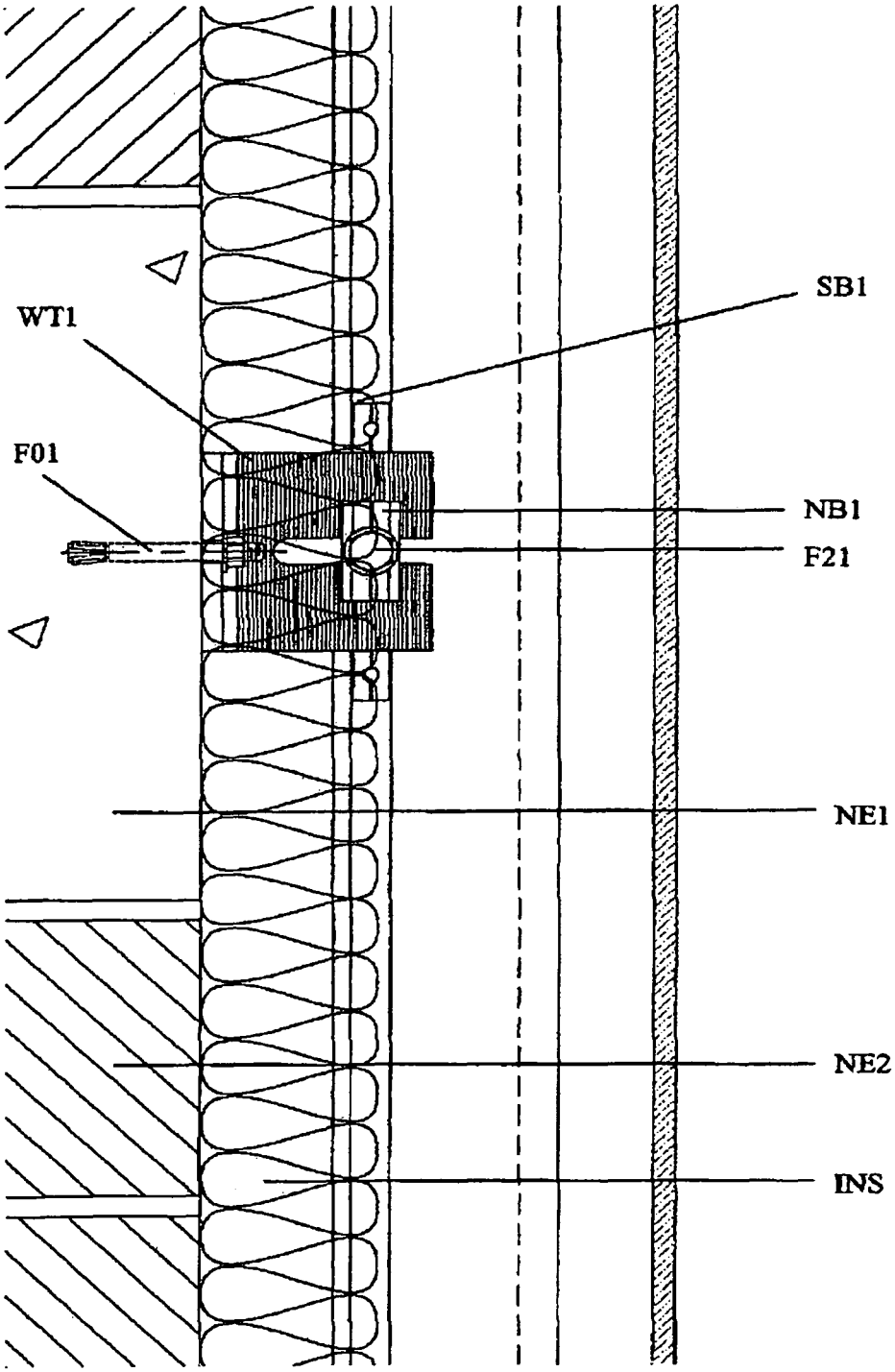
FIG. 10 is a view illustrating typical wind load anchor detail of the undercut clip anchor system of the present disclosure in use.
Figure 11:
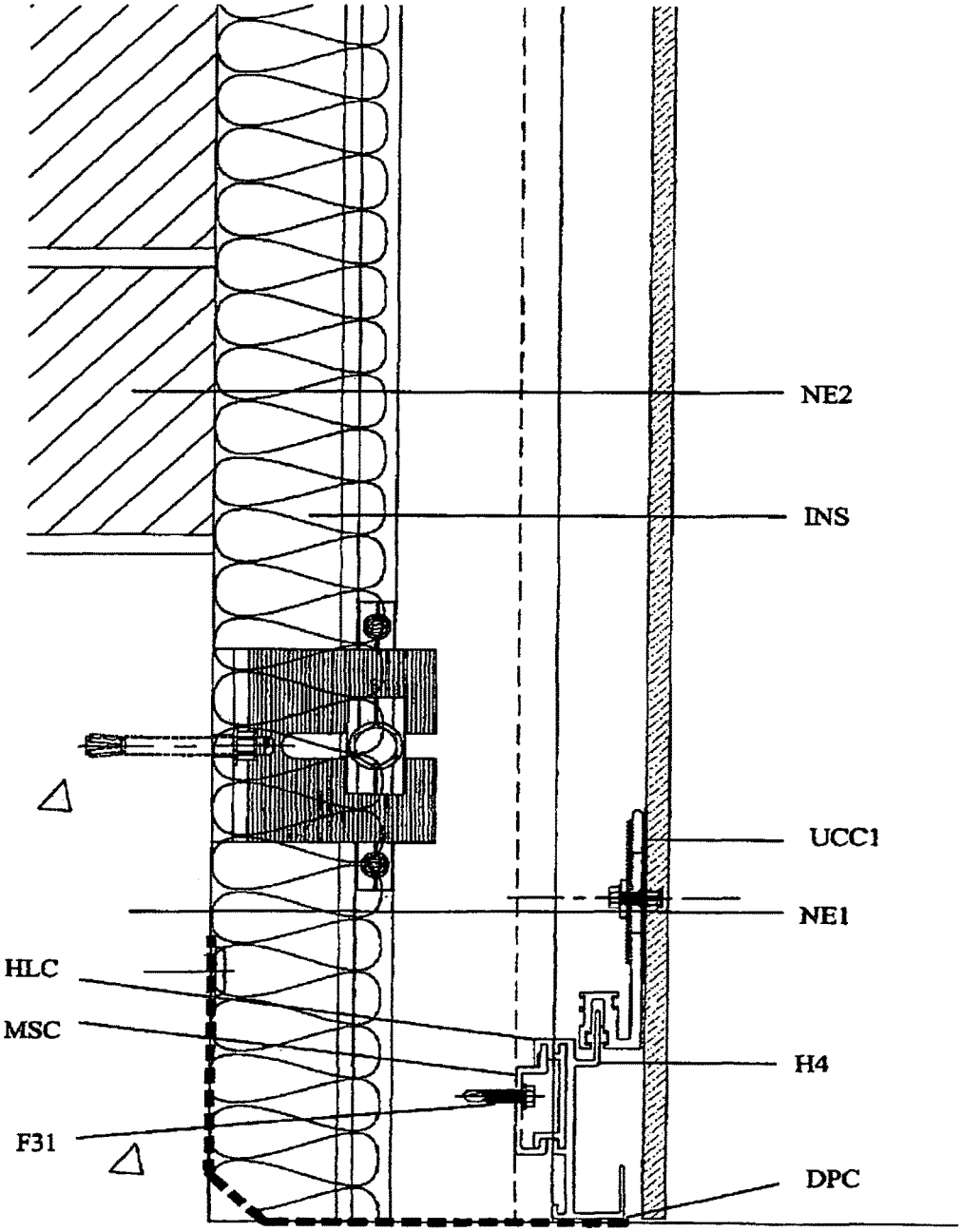
FIG. 11 is a view illustrating typical bottom clip detail of the undercut clip anchor system of the present disclosure in use.
Figure 12:
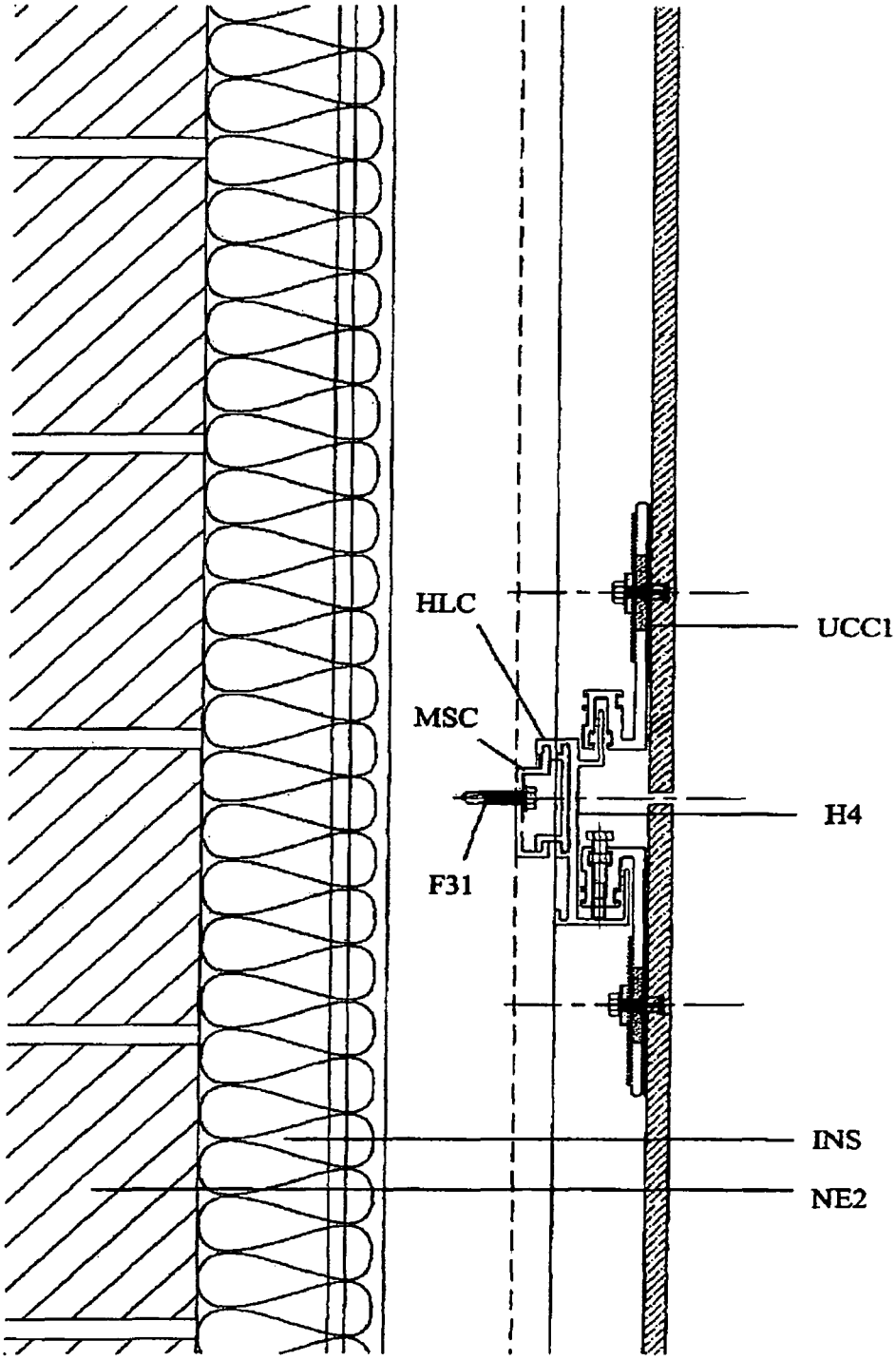
FIG. 12 is a view illustrating typical intermediate clip detail of the undercut clip anchor system of the present disclosure in use.
Figure 13:
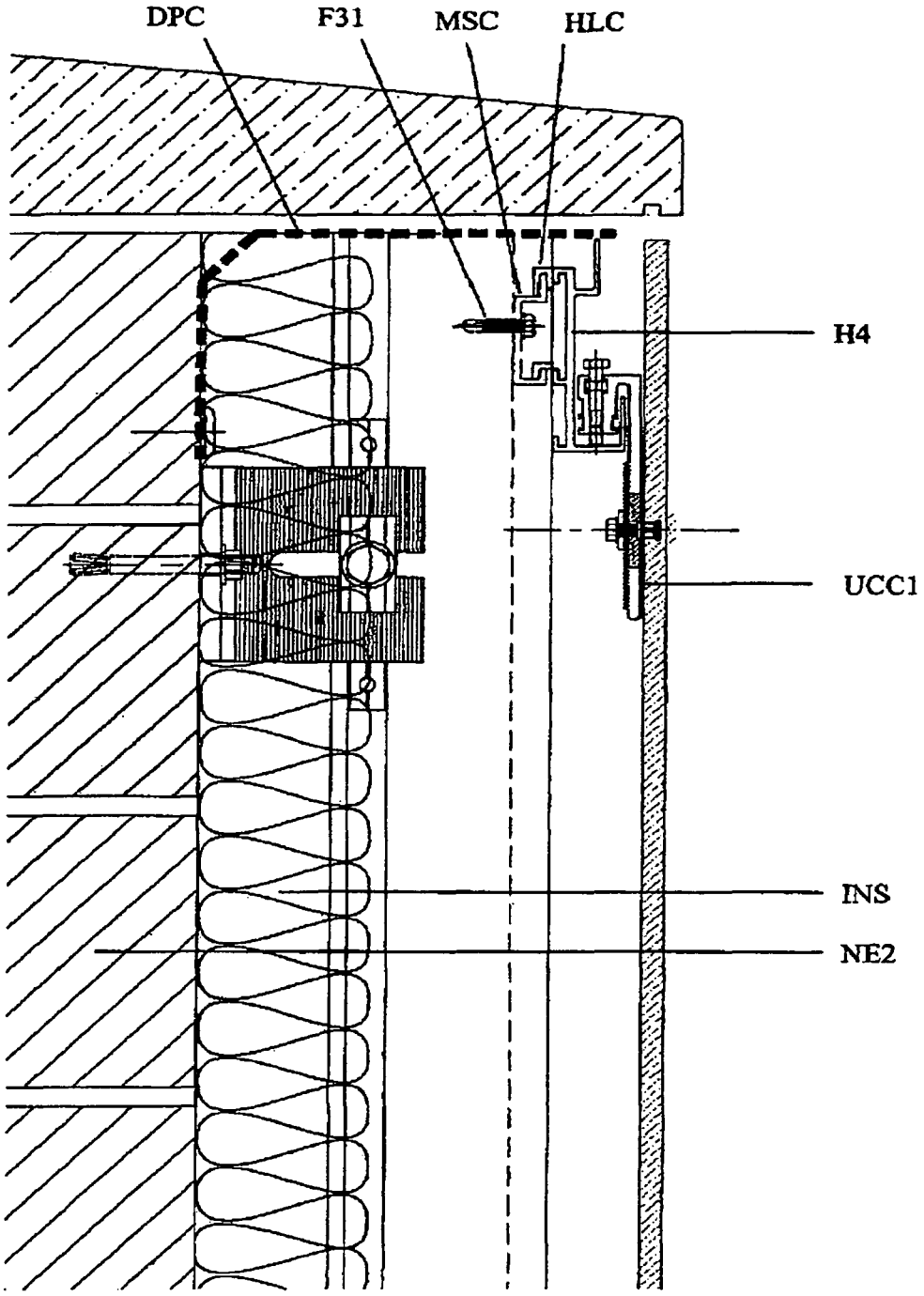
FIG. 13 is a view illustrating typical top clip detail of the undercut clip anchor system the present disclosure in use.
Figure 14:
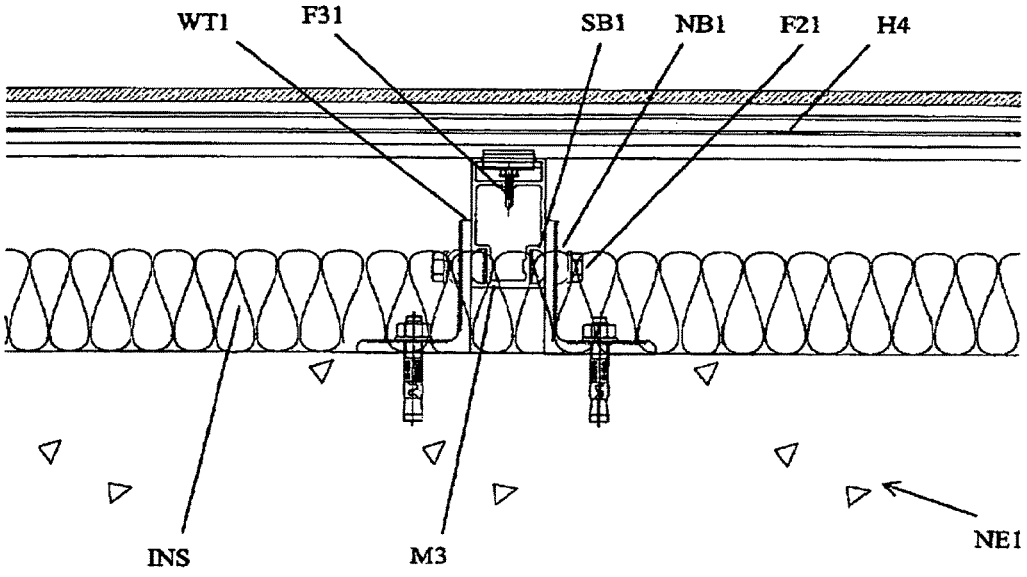
FIG. 14 is a view illustrating typical dead load anchor plan of the undercut clip anchor system of the present disclosure in use.

The following description refers to numerous specific details which are set forth by way of examples to provide a thorough understanding of the relevant teachings. It should be apparent to those skilled in the an that the present teachings may be practiced without such details. In other instances, well known methods, procedures, and components have been described at a relatively high-level, without detail, in order to avoid unnecessarily obscuring aspects of the present teachings.

The disclosed undercut clip anchor system comprises one or more of the following components, including without limitation: H3 or H3.1 horizontal rail, UCC1 or UCC2 undercut clips, NB3 nut bar serrated washer, undercut anchor such as Keil, GSD, or similar, bolt(s), e.g., 6 mm×40 mm hex head machine bolt, nut(s), e.g., 6 mm nut, and structural silicone or similar. These components are illustrated in the attached drawings and design detail.

Based on the particular installation or design, the H3 horizontal rail is attached to a back-up wall (metal stud, CMU, or concrete). Alternately, an H3.1 horizontal rail is attached to one of the Applicant's vertical mullions (M1, M12, or M4) via an MSC/HLC connection. The particular design will determine the spacing of these horizontal rails. The horizontal rails transfer the loading of the cladding material to the back-up structure.

As required by the particular design, a certain quantity (typically four) of the UCC clips are attached to the back of the cladding material with undercut anchors and the NB3 serrated washers. The M6 nuts and bolts are inserted into the UCC clips at the top of the material (typically two). When hanging/installing the cladding material, the bolt/nut/track interaction allows for the accurate vertical adjustment of the cladding panels. Structural silicone is applied to adhere the UCC clips and bolts to the horizontal rails.

The H3 horizontal rail is attached to a vertical substrate. Therefore, it transfers the load of the cladding material to that substrate. Four UCC clips are attached to the back of the cladding material via undercut anchors and are attached as shown on the detail. Two bolts and nuts are inserted into the tracks in the two UCC clips attached to the top of the cladding material as shown in the detail. Once all pieces are located properly, the cladding material can be addressed to the two H3 horizontal rails (one at the horizontal joint above and one at the horizontal joint below). The material can then be "hung" onto the horizontal rail above and restrained from rotation by the horizontal rail below. The weight of the material is transferred from the cladding material to the undercut anchors, which is then transferred to the undercut clips, which is then transferred to the nuts and bolts, which is then transferred to the horizontal rail, which is then transferred to the vertical substrate.

The same undercut clip (UCC) is used at the top and bottom of the cladding material, which minimizes the amount of different parts in the system. The nut/bolt/track configuration allows for quick and accurate installation of cladding materials. The H3 horizontal rail is designed to support the weight of the cladding material below it and restrain the cladding material above it from rotation or movement. The system is to be used for cladding panelized materials. It is ideal for use when anchors cannot be used at the top, bottom, or sides of the material.

In an alternate embodiment, the undercut clip anchor system of the present disclosure can be utilized with Applicant's ESW and/or ESV systems (incorporated herein by reference) by changing the H3 horizontal rail to the H3.1 horizontal rail which has a C-Channel along the back of the horizontal to accommodate the HLC (Horizontal Locking Clip). Thus, in lieu of attaching the H3 horizontal rail to a vertical substrate or back-up wall, the H3.1 horizontal rail can be used which incorporates a C-Channel along the back of it. This allows for Applicant's "Horizontal Direct Fixing" to be attached to it, so it could be used with any of Applicant's mullions and "snap" into place.

It is foreseen that any material could be clad with the use of this system if the material is strong enough and capable of taking an undercut anchor. Thus, while the system is particularly suited for use with natural stone, ceramic or porcelain tile, it could also be used to support other materials such as glass, concrete, wood, metal, etc. While the above discussed embodiment(s) have been described with reference to the attached drawings and detail, the system and components thereof generally can take any suitable size and shape. Additionally, the components can be made from any suitable material capable of adequately performing their respective intended functions.

While the preferred and alternate embodiment(s) are illustrative of the structure, function and operation of the exemplary method(s), system(s) and device(s), it should be understood that various modifications may be made thereto with departing from the teachings herein. While the foregoing discussion presents the teachings in an exemplary fashion with respect to the disclosed method, system and device for an undercut clip anchor system for cladding of materials, it will be apparent to those skilled in the art that the teachings may apply to any type of anchor system. Further, while the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein.

What is claimed is:

1. An undercut clip anchor system for anchoring cladding panels to a structure, the system comprising:

a horizontal rail having a mounting surface for mounting to the structure, an upper upward projection spaced a first distance from the mounting surface, and a lower upward projection spaced a second distance from the mounting surface, wherein the second distance is greater than the first distance; and an undercut clip having a substantially planar panel attachment portion, a first mounting wall portion, a second mounting wall portion, a first bridge portion connecting one end of the panel attachment portion and a first end of the first mounting wall portion, a second bridge portion connecting a second end of the first mounting wall portion and one end of the second mounting wall portion, a first mounting slot formed between the panel attachment portion and the first mounting wall portion, and a second mounting slot formed between the first mounting wall portion and the second mounting wall portion;

wherein the undercut clip is selectively mounted to the horizontal rail in one of a first position in which the upper upward projection is located in the second mounting slot, and a second position in which the lower upward projection is located in the first mounting slot, for anchoring a cladding panel, and wherein the undercut clip engages the cladding panel along the panel attachment portion and at no other location.

2. The system of claim 1, wherein the undercut clip has a mounting aperture in the panel attachment portion, and serrations formed in the panel attachment portion proximate the mounting aperture.

3. The system of claim 2, further comprising a nut bar washer having serrations for selectively engaging the serrations formed in the panel attachment portion of the undercut clip.

4. The system of claim 3, wherein the nut bar washer is selectively mounted along the mounting aperture to permit individual vertical adjustment in mounting cladding panels, and wherein the nut bar washer is coplanar with the first mounting slot.

5. The system of claim 1, wherein the upper upward projection engages the second mounting slot in the first position such that the undercut clip is in an upward orientation.

6. The system of claim 1, wherein the lower upward projection engages the first mounting slot in the second position such that the undercut clip is in a downward orientation.

7. The system of claim 1, wherein the undercut clip is configured to be used interchangeably in either the first position or the second position.

8. The system of claim 1, further comprising structural silicone in one of the first mounting slot and second mounting slot, wherein the first mounting slot and the second mounting slot are sized slightly larger than the size of the upper upward projection and the lower upward projection, such that the structural silicone fills in any open space in one of the first mounting slot and the second mounting slot when engaged with one of the upper upward projection and the lower upward projection.

9. A method for anchoring cladding panels to a structure, comprising the steps of:

attaching to the structure a horizontal rail having a mounting surface for mounting to the structure, an upper upward projection spaced a first distance from the mounting surface, and a lower upward projection spaced a second distance from the mounting surface, wherein the second distance is greater than the first distance;

mounting at least one undercut clip having a substantially planar panel attachment portion, a first mounting wall portion, a second mounting wall portion, a first bridge portion connecting one end of the panel attachment portion and a first end of the first mounting wall portion, a second bridge portion connecting a second end of the first mounting wall portion and one end of the second mounting wall portion, a first mounting slot formed between the panel attachment portion and the first mounting wall portion, and a second mounting slot formed between the first mounting wall portion and the second mounting wall portion, to the horizontal rail in one of a first position and a second position; and attaching a cladding panel to the at least one undercut clip, wherein the at least one undercut clip engages the cladding panel along the panel attachment portion and at no other location.

10. The method of claim 9, further comprising the steps of forming a mounting aperture in the panel attachment portion, and forming serrations in the panel attachment portion proximate the mounting aperture.

11. The method of claim 10, further comprising the step of associating a nut bar washer having serrations for selectively engaging the serrations formed in the panel attachment portion with the undercut clip.

12. The method of claim 11, further comprising the step of selectively mounting the nut bar washer along the mounting aperture to permit individual vertical adjustment in mounting cladding panels, and wherein the nut bar washer is coplanar with the first mounting slot.

13. The method of claim 9, wherein the step of mounting includes engaging the upper upward projection in the second mounting slot in the first position such that the undercut clip is in an upward orientation.

14. The method of claim 9, wherein the step of mounting includes engaging the lower upward projection in the first mounting slot in the second position such that the undercut clip is in a downward orientation.

15. The method of claim 9, wherein the step of mounting includes engaging the upper upward projection in the second mounting slot of a first undercut clip in the first position such that the first undercut clip is in an upward orientation; and engaging the lower upward projection in the first mounting slot of a second undercut clip in the second position such that the second undercut clip is in a downward orientation; wherein the first undercut clip and the second undercut clip have substantially the same configuration.

16. An undercut clip anchor system for anchoring cladding panels, the system comprising:

at least one horizontal rail defining a length and having a mounting surface for mounting to the structure, an upper upward projection along its length and spaced a first distance from the mounting surface, and a lower upward projection along its length and spaced a second distance from the mounting surface, wherein the second distance is greater than the first distance; and a plurality of undercut clips, each undercut clip having substantially the same configuration and having a substantially planar panel attachment portion, a first mounting wall portion, a second mounting wall portion, a first bridge portion connecting one end of the panel attachment portion and a first end of the first mounting wall portion, a second bridge portion connecting a second end of the first mounting wall portion and one end of the second mounting wall portion, a first mounting slot formed between the panel attachment portion and the first mounting wall portion, and a second mounting slot formed between the first mounting wall portion and the second mounting wall portion;

wherein each undercut clip is selectively mounted to the horizontal rail in one of a first position in which the upper upward projection is located in the second mounting slot, and a second position in which the lower upward projection is located in the first mounting slot, for anchoring at least one cladding panel, and wherein the plurality of undercut clips engage their respective cladding panels along their respective panel attachment portion and at no other location.

17. The system of claim 16, wherein at least one of the plurality of undercut clips is mounted on the upper upward projection via the second mounting slot in the first position such that the at least one undercut clip is in an upward orientation; and wherein at least one other of the plurality of undercut clips is mounted on the lower upward projection via the first mounting slot in the second position such that the at least one other undercut clip is in a downward orientation.

18. The system of claim 17, wherein the at least one undercut clip in the first position mounts an upper cladding panel, and wherein the at least one other undercut clip in the second position mounts a lower cladding panel.

19. The system of claim 17, further comprising structural silicone in the first mounting slot of the at least one undercut clip in the first position, and structural silicone in the second mounting slot of the at least one other undercut clip in the second position, wherein the first mounting slot and the second mounting slot are sized slightly larger than the size of the upper upward projection and the lower upward projection, such that the structural silicone fills in any open space in the first mounting slot and the second mounting slot when engaged with the upper upward projection and the lower upward projection respectively.

20. The system of claim 16, wherein a plurality of the undercut clips are mounted on the upper upward projection via their respective second mounting slot in the first position such that the plurality of undercut clips are in an upward orientation; and wherein a plurality of other undercut clips are mounted on the lower upward projection via their respective first mounting slot in the second position such that the plurality of other undercut clips are in a downward orientation.

* * * * *